US005083774A

United States Patent [19]

Yalvac

[11] Patent Number: 5,083,774

[45] Date of Patent: Jan. 28, 1992

[54] BASEBALL PITCHING TARGET DEVICE

[76] Inventor: Fikri Yalvac, 22 Coolidge Dr., Berkeley Heights, N.J. 07922-2004

[21] Appl. No.: 661,335

[22] Filed: Feb. 27, 1991

[51] Int. Cl.[5] ..... A63B 69/40

[52] U.S. Cl. ..... 273/26 A

[58] Field of Search ..... 273/26 A, 29 A, 177 A, 273/181 A, 181 F, 389, 390, 398, 402, 127 B, 127 D

[56] References Cited

U.S. PATENT DOCUMENTS

| | | | |
|---|---|---|---|
| 3,633,909 | 1/1972 | Doynow | 273/26 A |
| 3,810,616 | 5/1974 | Murphy | 273/26 A |
| 4,068,846 | 1/1978 | Forrest | 273/181 A |
| 4,354,952 | 3/1981 | Playter, Jr. | 273/26 A |
| 4,473,227 | 9/1984 | Klaus | 273/26 A |
| 4,497,485 | 2/1985 | Macosko | 273/26 A |
| 4,905,996 | 2/1990 | Tallent et al. | 273/29 A |
| 4,930,774 | 6/1990 | Butcher | 273/26 A |

*Primary Examiner*—Theatrice Brown

[57] ABSTRACT

The present invention relates to a baseball pitching target device. This comprises a baseball pitching target area subdivided into specific strike zone or hit zone nets which tray a pitched baseball. The target zone nets are contained within and are supported by a pivoting frame assembly which is secured to an underlying base.

1 Claim, 4 Drawing Sheets

BASEBALL PITCHING TARGET DEVICE

BACKGROUND OF THE INVENTION

1. Field of the Invention

This invention relates in general to target devices used in ball sports, and deals more particularly with a target to be used by baseball players to practice baseball pitching and to assess the accuracy of the aim of each pitched baseball.

2. Description of the Prior Art

The pitching target device of the present invention is particularly suitable for use by one or more players in practicing and assessing baseball pitching skills. Prior art reveals several target composites for ball sports such as U.S. Pat. No. 3,206,196 to Jackson wherein the invention comprises a frame mounted rebound net and a target net to which are attached a ball zone plate and a strike zone plate. Circuitry and indicator lights are also part of the composite. Pitched balls impact upon the zone plates to activate related circuitry and indicator lights. U.S. Pat. No. 4,872,674 to Deal similarly comprises a plurality of frame mounted nets with the additional feature of a specific target zone indicated by a tennis ball, or simulation thereof, within a strike zone. Moreover, U.S. Pat. No. 4,905,996 to Tallent and Tallent discloses another composite of frame mounted nets with a main net superposed by a pouch like inner net, the position of the inner net made variable by attachment of the net to movable straps. Another embodiment of a ball target device is presented in U.S. Pat. No. 4,118,028 to Larkin wherein the invention comprises two sheets of flexible material vertically suspended in superposed and spaced apart relationship. Specific target areas are provided in each sheet, and the sheets together form a ball collection area.

While the inventions of Jackson, Deal, Tallent and Tallent, and Larkin all provide variant target zones, no one device is specifically designed to simulate the actual pitching target zones contained within the vertical plane over home plate during a baseball game. Moreover, these devices are generally limited in their ability to alleviate the impact force of pitched baseballs. In view of these limitations, it may be appreciated that there is a continuing need for the development of a new and improved baseball pitching target device which addresses the problem of specific relevance to the sport of baseball, and which provides for alleviation of the impact force of pitched baseballs. It is the purpose of the present invention to address these needs in a unique and unprecedented manner.

SUMMARY OF THE INVENTION

The present invention relates to a baseball pitching target device. The device consists of a rectangular shaped frame with an attached crossbar, both of which are combined with two attached strings and two attached nets to comprise the frame assembly. The frame assembly is connected to an underlying base by pivotal bolts passing horizontally through legs of the frame assembly and support blocks which are attached to the base. At rest, the frame assembly is held in a vertical position by two extension springs whose ends are attached diagonally between the frame assembly ends and the base, as well as by two stops protruding from the lower interior surfaces of the support blocks.

A baseball pitched to the device is trapped in one of the nets, and the force of the baseball striking the net causes the frame assembly to pivot downward and away from the pitcher. The frame assembly pivots downward approximately 55 degrees at which point movement of the frame assembly legs is blocked by two stops in the upper interior surfaces of the support blocks. In response to the downward pivoting of the frame assembly, extension springs attached diagonally between the frame assembly ends and the base expand, thereby alleviating the impact force of the pitched baseball upon the frame assembly. The extension springs then contract to return the frame assembly to a resting, vertical position.

Use of this invention allows a baseball pitcher to evaluate the accuracy of each baseball pitched according to where the baseball is trapped by the nets of the target device.

DETAILED DESCRIPTION OF THE DRAWINGS

Figure 1:
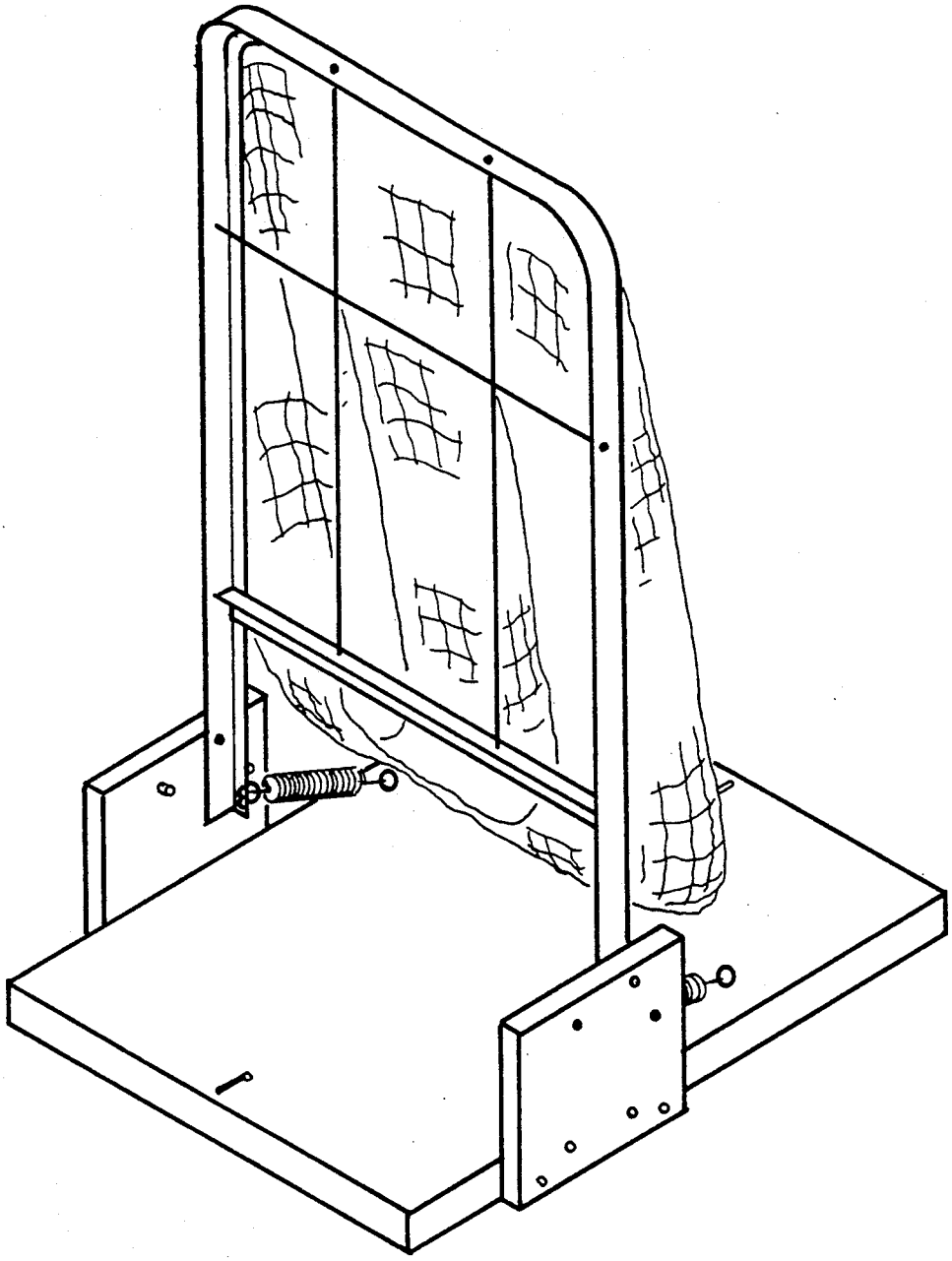
FIG. 1 is a perspective view of a typical baseball pitching target device embodying the present invention.
Figure 2:
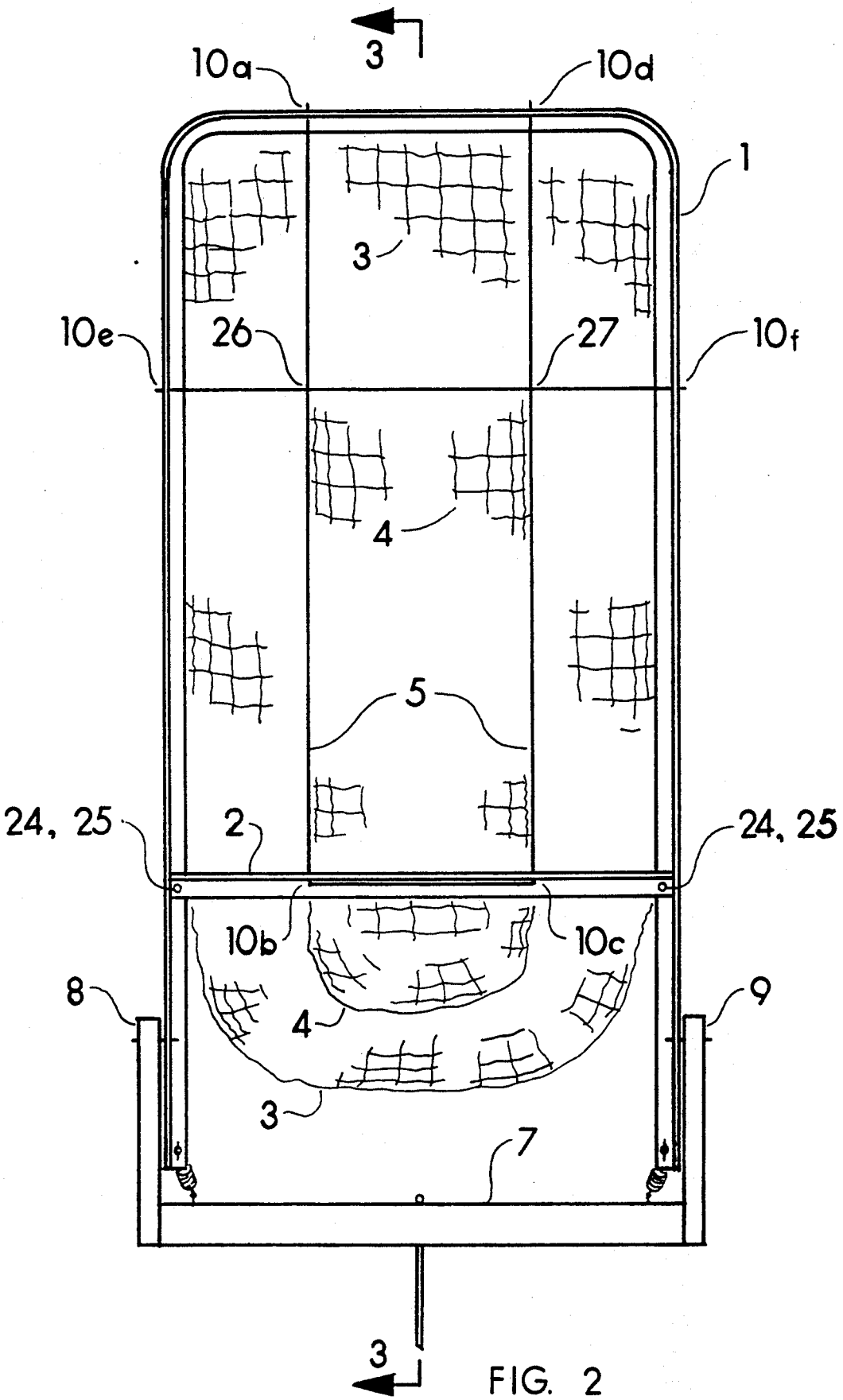
FIG. 2 is a front view of a typical composite of elements of FIG. 1.
Figure 3:
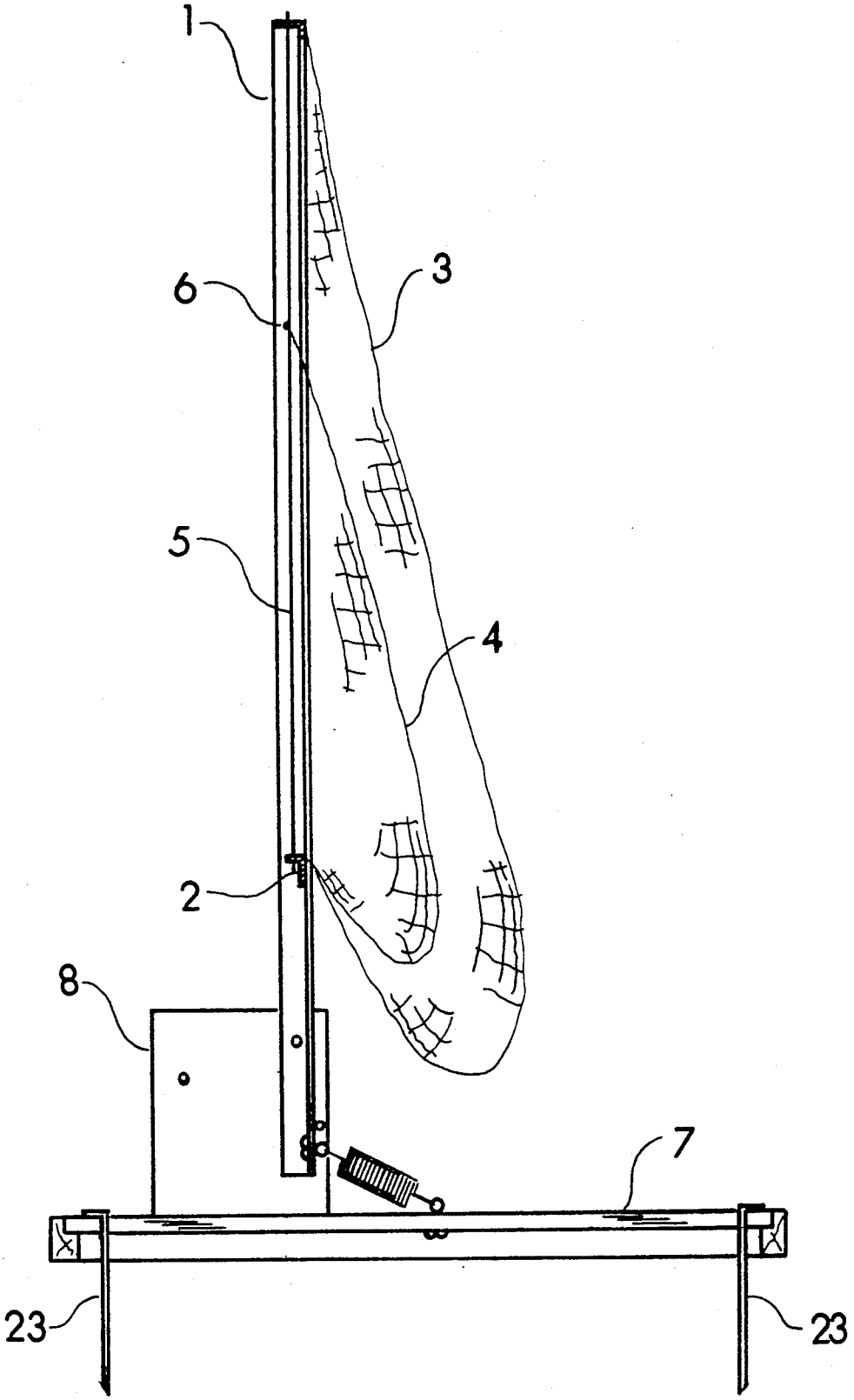
FIG. 3 is a cross section through the plane indicated by the arrows 3—3 of FIG. 2.

Referring now to FIGS. 1, 2, and 3 of the drawings, a typical embodiment of the present invention comprises a vertically disposed frame 1 fabricated from a length of semi-rigid material such as aluminum, steel, reinforced fiberglass, or polyvinylchloride, any of which may have an angle, round, square, or rectangular cross section. In the present example, the frame 1 is an eight foot section of aluminum having an angle cross section and which has been bent into a three-sided, rectangular shaped frame 1, having at its uppermost portion rounded corners of approximately 90 degrees each. The frame 1 legs are open-ended at the lowest portion of the frame 1, and the frame 1 legs are reinforced by a crossbar 2, which in the present example is 19 inches long and which is attached to the frame 1 legs by bolts 24, 24 and nuts 25, 25.

The area defined by the frame 1 and the crossbar 2, and which lies in the vertical plane above the juncture of the frame 1 and crossbar 2, comprises a target zone which is subdivided by strings 5, 6. One string 5 passes through holes 10*a*, 10*b*, 10*c*, and 10*d* located in the uppermost lateral portion of the frame 1 and in the crossbar 2 at points which in the present example lie 5½ inches interior to the legs of the frame 1. The string 5, which in the present example is 68½ inches long, enters the frame 1 at a hole 10*a* in the uppermost, lateral portion of the frame 1, descends longitudinally and passes through a hole 10*b* in the crossbar 2, proceeds laterally along the crossbar 2 to the next hole 10*c* in the crossbar 2, passes through the hole 10*c*, and ascends longitudinally to the uppermost, lateral portion of the frame 1 where the string 5 passes through the last hole 10*d*. Each end of the string 5 is secured to the frame 1 by means of a knot tied in each end of the string 5, both at the hole 10*a* and at the hole 10*d* through which the string 5 passes. The target area is also divided by another string 6, which in the present example is 21 inches long, secured by a knot to the frame 1 leg at a hole 10*e*, which in the present example is at a point 31 inches above the cut end of the frame 1 leg. The string 6 proceeds from the exterior surface of the frame 1 leg, passes through the hole 10*e*, and extends transversely to the hole 10*f* in the other frame 1 leg while intersecting the longitudinally disposed string 5 at points of intersection 26, 27. At the hole 10*f*, the end of the string 6 is tied into a knot which secures the string 6 to the frame 1 leg.

Attached to the frame 1 and to the strings 5, 6, are two nets 3, 4 which indicate distinct target zones. A strike zone is formed by the larger net 3, which in the present example is 45 inches long and 26 inches wide. The net 3 is attached to the uppermost lateral portion of the frame 1 and to the frame 1 legs above the points of intersection 26, 27 with the crossbar 2, as well as to the crossbar 2. A pouch, which in the present example is approximately 8 inches deep, is formed by excess net 3 material and lies below the crossbar 2 and traps pitched baseballs which have hit the net 3. Any baseball hitting and landing in this net 3 is considered a strike as if the baseball pitcher were pitching to a batter in an actual baseball game. Another, smaller net 4, which in the present example is 31 inches long and 15 inches wide, is superposed upon the larger net 3. The net 4 is held in place at its uppermost edge by the laterally disposed string 6 between the points of intersection 26, 27 of the strings 5, 6. Also securing the net 4 is the longitudinally disposed string 5, 5 below the points of intersection 26, 27 of the strings 5, 6. Also securing the net 4 is the longitudinally disposed string 5, 5 below the points of intersection 26, 27 of the strings 5, 6. The lower edge of the net 4 is secured by the crossbar 2 between the crossbar holes 10*b*, 10*c*. A pouch, which in the present example is 5 inches deep, is formed by excess net 4 material and lies below the crossbar 2 and traps pitched baseballs which have hit the net 4. Any pitched baseball hitting and landing in this net 4 is rated a hit as if the baseball pitcher were pitching to a baseball batter in an actual baseball game.

Figure 4:
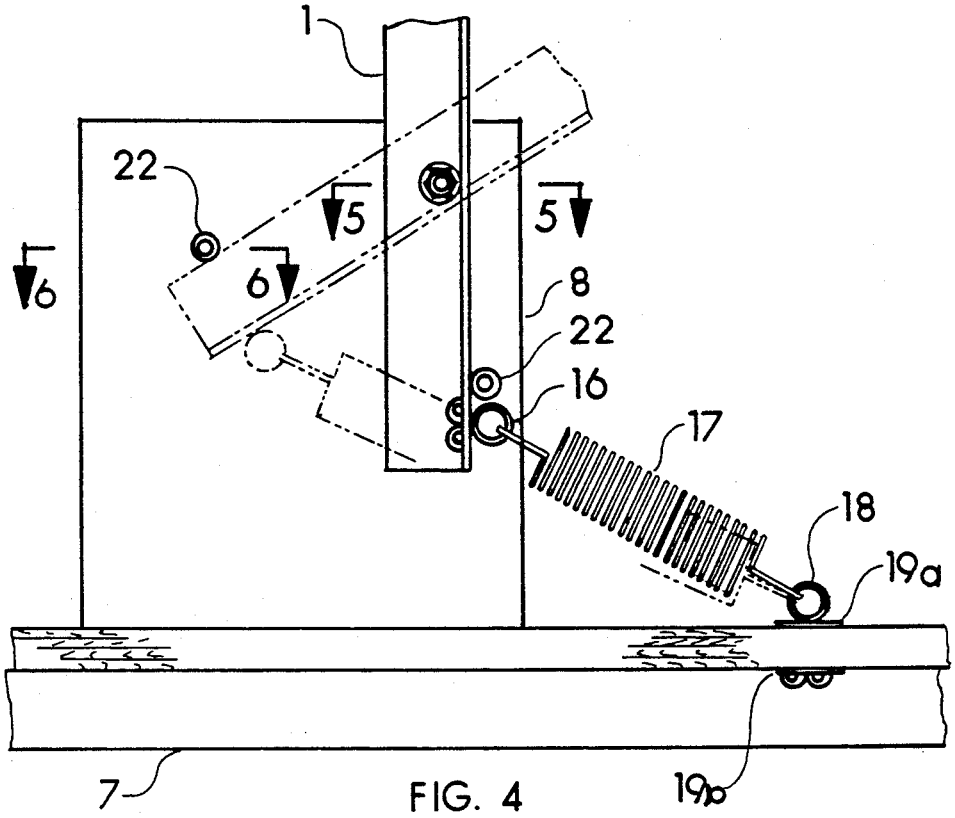
FIG. 4 is a side view showing details of the extension springs mechanism while the frame is at rest and, in phantom, while the frame and the extension springs move in reaction to the impact of a pitched baseball striking the target device.
Figure 5:
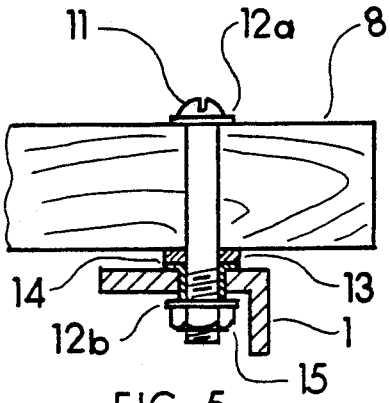
FIG. 5 shows details of the pivotal bolts of the present invention along the plane indicated by the arrows 5—5 of FIG. 4.

Referring to FIG. 4, there is shown a side view of a typical embodiment of the present invention with the frame 1 and an extension spring 17 shown at rest and, in phantom, the frame 1 and an extension spring 17 shown moving in reaction to the impact of a pitched baseball striking the target device. At a point in the frame 1, which in the present example is 4 inches above each cut end of the frame 1, the frame 1 is connected by means of pivotal bolts 11 to the interior surface of a support block 8 which is perpendicularly attached to the base 7 by means of wood screws. In the present example, the support blocks 8, 9 are wood, and measure ¾ inch thick, 5½ inches wide, and 7 inches high. As shown in FIG. 5, each bolt 11 passes laterally through a washer 12*a*, a vertically disposed support block 8, a spacer 13, a frame 1 leg, a flanged bushing 14, and a washer 12*b*, all of which are secured by a nut 15 at the threaded end of the bolt 11. Support block 9 and its attachments are the same as those described for support block 8, except that support block 9 is a mirror image of support block 8.

Figure 6:
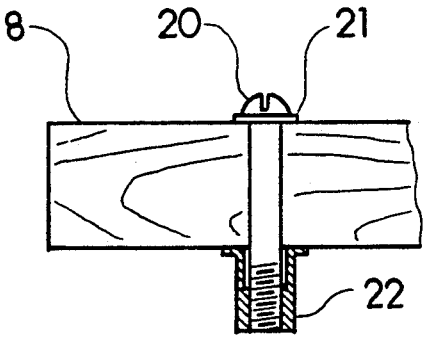
FIG. 6 shows details of the stops of the present invention along the plane indicated by the arrows 6—6 of FIG. 4.

Upon a pitched baseball hitting and being trapped in one of the nets 3, 4, the frame 1 rotates upon the pivotal bolts 11, 11 in a path which is downward and away from the pitcher, thereby absorbing the impact of the pitched baseball. The downward pivoting of the frame 1 ceases and the frame 1 remains inclined at a 55 degree angle when the downward pivoting frame 1 strikes the stops 22, 22 mounted on the upper interior surfaces of the support blocks 8, 9. Referring to FIG. 6, each stop 22, 22 comprises a threaded bolt 20 which is mounted from the exterior surface of a support block 8, and passes through a washer 21, a support block 8, and a threaded flanged bushing 22 which secures the bolt 20 in position.

Referring again to FIG. 4, each end of the frame 1 is attached to the base 7 by means of an extension spring 17 secured to the frame 1 and to the base 7 by closed loop clips 16, 18. At a point on the frame leg, which in the present example is 1 inch above the lower frame 1 end, there is a drilled hole through which the open ends of a closed loop clip 16 are passed, entering from the rear of the device frame 1 and exiting from the front of the frame 1. The open ends of the clip 16 are then bent towards the frame to secure the clip 16 to the frame 1. To the clip 16 is secured an extension spring 17 whose other end is similarly attached to a closed loop clip 18 positioned in the upper surface of the base 7. At a point on the upper surface of the base 7, which in the present example lies 12¼ inches from the front of the base 7 and 1¼ inches from the side of the base 7, the open ends of a closed loop clip 18 are passed from the upper surface of the base 7 through a washer 19*a*, through a hole drilled in the base 7, and through a washer 19*b*. The open ends of the clip 18 are then bent toward the base 7 to secure the clip 18 to the underside of the base 7. In the present example of the invention, the base 7 is a plywood board 23¾ inches long, 18⅜ inches wide, and ½ inch thick. In the present example of the invention, the sides of the base 7 are enclosed by L shaped wooden molding which is perpendicularly attached by means of wood screws to each side of the base 7 to lie flush with the upper surface of the base 7.

Two holes drilled in the upper surface of the base 7, in the present example at points located 3 inches from the front and rear edges of the base 7 and equidistant from each side of the base 7, are provided for spikes 23, 23, each of which is passed vertically from the upper surface of the base 7, through a hole in the base 7, and into a semi-solid underlying surface, such as a grassy playing field, to anchor the base 7 with the attached device to one location during use.

It will be understood that the scope of the present invention is not limited to the form, structure, or dimensions given herein by way of illustration, but only by the scope of appended claims.

What I claim is:

1. A baseball pitcher's target device comprising:

a substantially rectangular rigid horizontal base member (7); a pair of vertically extending support blocks (8, 9) each support block being attached to opposite sides of said base member (7);

a rigid U-shaped frame member (1), said U-shaped frame member having each free end member of each thereof pivotally attached to a respective support block (8, 9), said frame further having a rigid, horizontally extending crossbar (2) attached adjacent each said free end;

a pair of spaced apart string means (5) extending longitudinally of said frame each said string means having an end attached to said frame and said crossbar to define an opening therebetween and an opening between each said string and an adjacent leg of said U-shaped frame;

a third string (6), said third string extending transversely of said U-shaped frame a predetermined distance from said horizontal crossbar and having its ends attached to said frame member to define a central opening which is bordered by said pair of strings, said third string and said crossbar;

a first ball restraining net pocket (3) having its open end edge attached about the perimeter of an opening crossbar (2), and a second ball restraining net pocket (4) having its open end edge attached to the perimeter of said central opening, said second pocket being capable of catching and retaining balls passing only through said central opening while said first pocket being capable of catching and retaining balls passing only through the remaining openings defined by the perimeter of said frame (1); said crossbar (2) and said pair of string means (5, 6); said first pocket (3) being larger than said second pocket (4); spring means (17) attached between an end of each leg of said U-shaped frame member (1) and said base member (7);

each said support block having first and second horizontally extending spaced apart stop means (22) one of said stop means being capable of stopping said frame in a substantially vertical plane and said the other of said stop means being capable of stopping said frame in an inclined plane when said frame is pivoted from said vertical plane, said spring means biasing said frame means towards a said stop means when said frame is in said vertical plane whereby said frame is self-erecting when pivoted from said vertical plane;

spike means (23) extending through said base for anchoring said apparatus to a support surface.

* * * * *